US005516111A

United States Patent [19]

Strickland, Jr.

[11] Patent Number: 5,516,111

[45] Date of Patent: May 14, 1996

[54] SKILL AND KNOWLEDGE GAME

[76] Inventor: Roy T. Strickland, Jr., 1901 Westover Dr., Goldsboro, N.C. 27530

[21] Appl. No.: 300,420

[22] Filed: Sep. 2, 1994

[51] Int. Cl.[6] ..... A63F 3/06

[52] U.S. Cl. ..... 273/269; 273/430

[58] Field of Search ..... 273/269, 429–433

[56] References Cited

U.S. PATENT DOCUMENTS 2,769,640 11/1956 Elder ..... 273/269
3,545,101 12/1970 Fike ..... 273/269
3,589,729 6/1971 Girard ..... 273/269
4,021,937 5/1977 Kravitz ..... 273/269
4.953,869 9/1990 Muhammad ..... 273/269

*Primary Examiner*—Benjamin H. Layno
*Attorney, Agent, or Firm*—Robert M. Wolters

[57] ABSTRACT

A game of skill and knowledge is provided having questions the answers to which depend on a mature person's general knowledge. Boards are provided to each player, and there are answer spaces arranged in vertical columns and horizontal rows. Each space has a number thereon used in determining the free spaces. There is a list of questions to be asked by a host. These questions are called or displayed at random relative to the answers.

5 Claims, 6 Drawing Sheets

1. HANK AARON: What famous baseball player broke Babe Ruth's home run record?

2. ROY ACUFF: What country music singer and fiddler made famous the song, "The Wabash Cannonball"?

3. MUHAMMED ALI: What was heavyweight boxer Cassuis Clay's adopted Muslin name?

4. JOHNNY APPLESEED: What was John Chapman's given name that planted large numbers of apple trees along the early frontier?

5. GENE AUTRY: Who was the famous singing cowboy who recorded, "Rudolph the Red Nose Raindeer" and "Frosty the Snowman"?

6. P.T. BARNUM: Who along with Ringling Bros., and Bailey formed the most traveling circus?

7. ALEXANDER GRAHAM BELL: What American scientist invented the telephone?

8. DANIEL BOONE: What American pioneer blazed the "Wilderness Trail from Virginia to Kentucky"?

9. GEORGE BUSH: What Republican president served as Ronald Reagan's vice–president from 1980 – 1988?

10. JULIUS CEASAR: What Roman emperor was stabbed to death by men believed to be his friends?

11. JOHNNY CARSON: What popular entertainer became famous for hosting "The Tonight Show"?

12. JIMMY CARTER: What president was successful in peanut farming before politics?

13. GEORGE WASHINGTON CARVER: What Afro–American scientist was internationally famous for agricultural research in peanuts?

14. SHIRLEY CHISHOLM: Who was the first Afro–American woman elected to the U. S. Congress?

15. DICK CLARK: What entertainer developed and hosted the show "American Band Stand"?

16. SANTA CLAUS: What legendary figure is known for bringing gifts to children on Christmas Eve?

17. CHRISTOPHER COLUMBUS: What Spanish explorer was known for the discovery of the Americas?

18. DAVID: What Biblical man killed the giant, Goliath, with a sling and five stones?

19. WALT DISNEY: What famous person created the cartoon characters Mickey Mouse and Donald Duck?

20. DONALD DUCK: What famous Walt Disney character is Uncle to Huey, Duey and Luey?

21. DALE EARNHARDT: What NASCAR driver in 1994 won his 5th Winston Cup Point championship?

22. WYATT EARP: What American West frontiersman took part in the gunfight at the OK Corral known to be bold, courageous, and strong?

23. THOMAS EDISON: What inventor invented the light bulb and phonograph?

24. ALBERT EINSTEIN: Known as one of the greatest scientists famous for his theroy of relativity – E=MC2 – What is his name?

25. QUEEN ELIZABETH II: What lady has been the reigning Monarch of England since 1952?

26. BENJAMIN FRANKLIN: What great American contributed to the Declaration of Independence and was also known for proving lighting is electricity?

27. HENRY FORD: Who was the leading manufacturer of American Automobiles in the early 1900's including the Model T?

FIG. 4–A

28. A.J. FOYT: What race car driver has won the Indianapolis 500 four different times?

29. GERONIMO: What was the famous Apache Indian warrior's name which meant "Jerome" in spanish?

30. BILLY GRAHAM: What famous evangelist is known for his world wide Christian crusades?

31. JOHN GLENN: What U.S. astronaut first orbited the earth?

32. PAUL HARVEY: What famous radio news commentator completes his commentary with "and now you know the rest of the story"?

33. PATRICK HENRY: What early American statesmsn is most remembered for his words, "Give me Liberty or give me Death"?

34. BUDDY HOLLY: What rock-n-roller recorded, "Peggy Sue" and later died in a plane crash?

35. SHERLOCK HOLMES: Who was the most famous fictitious detective with the help of Dr. Watson?

36. HOWARD HUGHES: Who was one of the wealthiest men in the 1950's who later became a recluse?

37. LEE IOCOCCA: Who was chairman of Chrysler Corporation known for saving it from bankruptcy?

38. JESUS: What man did the Christians believe was the "Son of God"?

39. LYNDON JOHNSOM: Who became president upon John F. Kennedy's assassination?

40. MICHAEL JORDAN: What famous basketball star played for the Chicago Bulls after graduating from UNC?

41. HELEN KELLER: What female being deaf and blind later established a school for the blind?

42. JOHN KENNEDY: What congressman became the youngest U.S. President and was later assassinated?

43. CLARK KENT: What mild mannered reporter became superman?

44. FRANCIS SCOTT KEY: What man first called the U.S. flag -- The Star Spangled Banner?

45. MARTIN LUTHER KING: What famous Afro-American minister was known for his speech, "I have a dream"?

46. ABRAHAM LINCOLN: Which great president was assassinated at Ford's Theater by John Wilkes Booth?

47. VINCE LOMBARDI: Who was the pro-football coach whose motto was, "Winning isn't everthing; It's the only thing"?

48. LORETTA LYNN: What country western lady singer recorded, "A Coal Miner's Daughter"?

49. JAMES MONROE: Who was the 5th U.S. President best known for his historic Doctrine?

50. MARILYN MONROE: Norma Jean Baker was the real name of this blonde world famous sex symbol. What was her name?

51. SAMUEL MORSE: What inventor invented the code to send telegraphic messages?

52. MOSES: What Biblical leader led his people out of Egypt during Pharaoh's regine?

53. JOE NAMATH: This famous NFL Jet's quarterback's nickname was Broadway. Who was he?

54. NAPOLEON: What Emperor of France in 1804 was married to Empress Josephine?

FIG. 4-B

55. FLORENCE NIGHTINGALE: Who founded the nursing profession as we know it today?

56. RICHARD M. NIXON: Who was the only one U.S. President ever to resign from office?

57. NOAH: Who was the biblical man who built the ark before the earth flooded?

58. ARISTOTLE ONASSIS: What Greek shipowner married Jacqueline Kennedy?

59. ARNOLD PALMER: Who became one of the greatest and popular players in the history of golf?

60. GEORGE PATTON: What was the name of this colorful American General of WWII nicknamed "Old Blood and Guts"?

61. RICHARD PETTY: What famous NASCAR driver won the national racing title 6 times and his number is 43?

62. ELVIS PRESLEY: Who is the King of Rock—n—Roll?

63. LONE RANGER: What western hero's side kick was named Tonto and his horse named Silver?

64. RONALD REAGAN: What U.S. Republican President served his term between 1980 and 1988?

65. PAUL REVERE: What American patriot was famous for his midnight ride?

66. SALLY RIDE: What U.S. Astronaut became the first woman to travel in space?

67. JACKIE ROBINSON: Who was the first Afro—American to play major league baseball?

68. FRANKLIN ROOSEVELT: What U.S. President served 4 times including WWII and had a cousin named Theodore?

69. BETSY ROSS: Who was the lady believed to make the first American flag with stars and stripes?

70. BABE RUTH: who was the first great home run hitter in baseball history?

71. EDWARD TEACH: What was Blackbeard the pirate's real name?

72. MARK TWAIN: What was major author of American fiction Samuel Clemens, pen name?

73. GEORGE WASHINGTON: Who was the first United States President?

74. JOHN WAYNE: Who was the most famous cowboy actor in westerns in American history?

75. SIR WINSTON CHURCH HILL: Who reached the height of his fame as heroic Prime Minister of Great Britian during WWII?

FIG. 4—C

SKILL AND KNOWLEDGE GAME

BACKGROUND OF THE INVENTION

Many games resembling bingo have been patented. Most such games have an element of chance in them, or are severely restricted as to subject matter. For example, they may be children's games, or they may be Bible games, etc. Games of relative skilled areas may appeal to those having that particular skill, but are of little interest to others. Games involving chance come under various state laws which may vary from state to state, and which involve considerable confusion as to what is permitted and what the stakes may be.

OBJECTS AND SHORT SUMMARY OF THE INVENTION

It is an object of the present invention to provide a game similar to bingo which does not rely in any aspect on chance, and is not restricted as to subject matter. Most specifically, the game is of general skills and knowledge and will appeal to an adult with common skills and knowledge.

Each person playing the game is given a board having 25 spaces thereon, comprising five rows and five columns. Each space is numbered 1 thru 25. Well known persons' names or other areas of knowledge are displayed in the columns and rows, and each represents the answer to a question to be asked by the person who runs the game.

When an answer is recognized a marker is placed on that square. When markers are placed in the designated pattern or patterns, the person will indicate he has the correct pattern, and a careful comparison will then be made to be sure that he is right.

THE DRAWINGS

The game will best be understood with reference to the accompanying drawings wherein.

FIGS. 4A through 4C comprise a list of questions to be asked of the players duing the game.

DETAILED DISCLOSURE OF THE ILLUSTRATIVE EMBODIMENT

Figure 1:
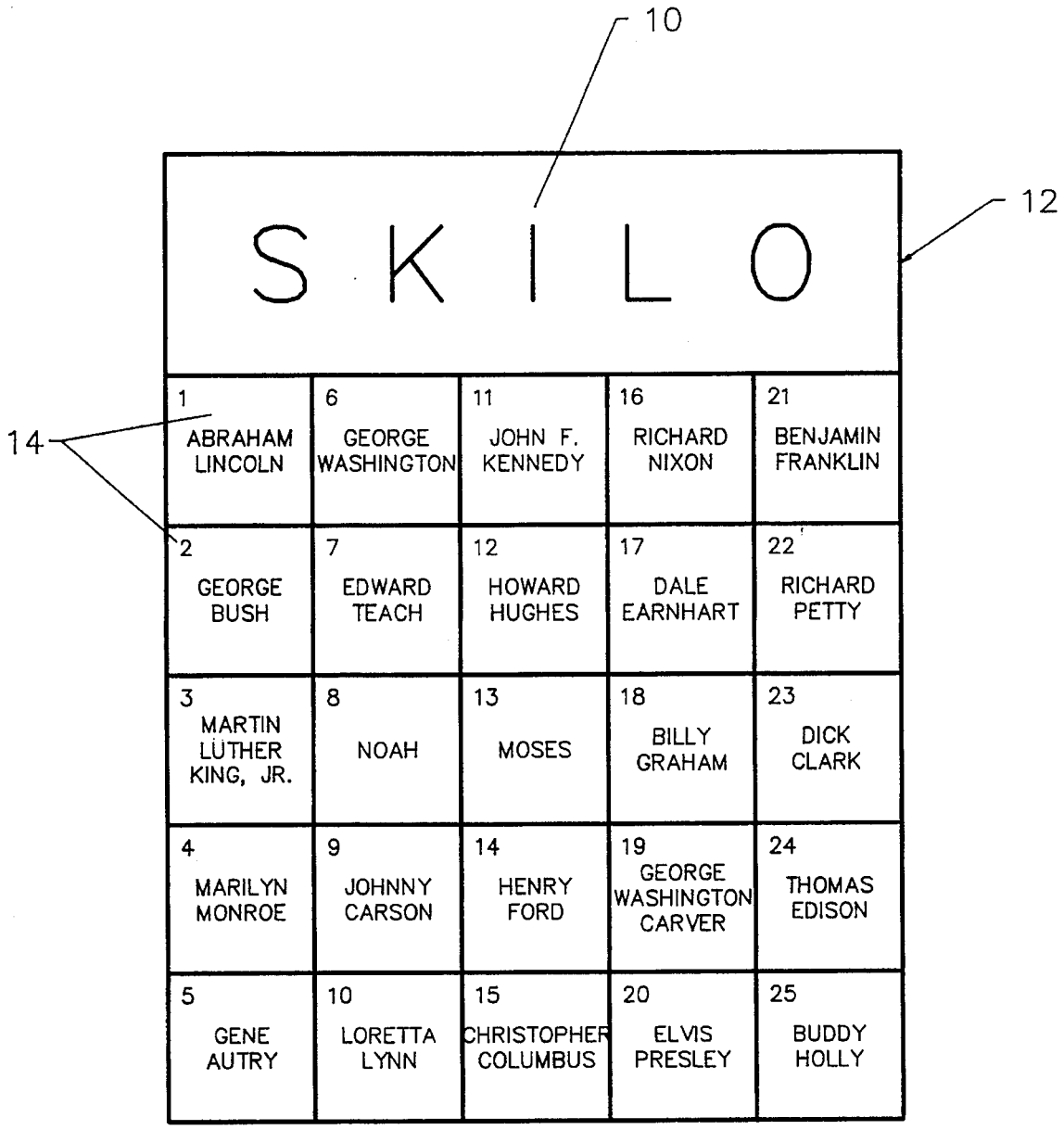
FIG. 1 is a plan view of the game board comprising a part of my invention.
Figure 2:
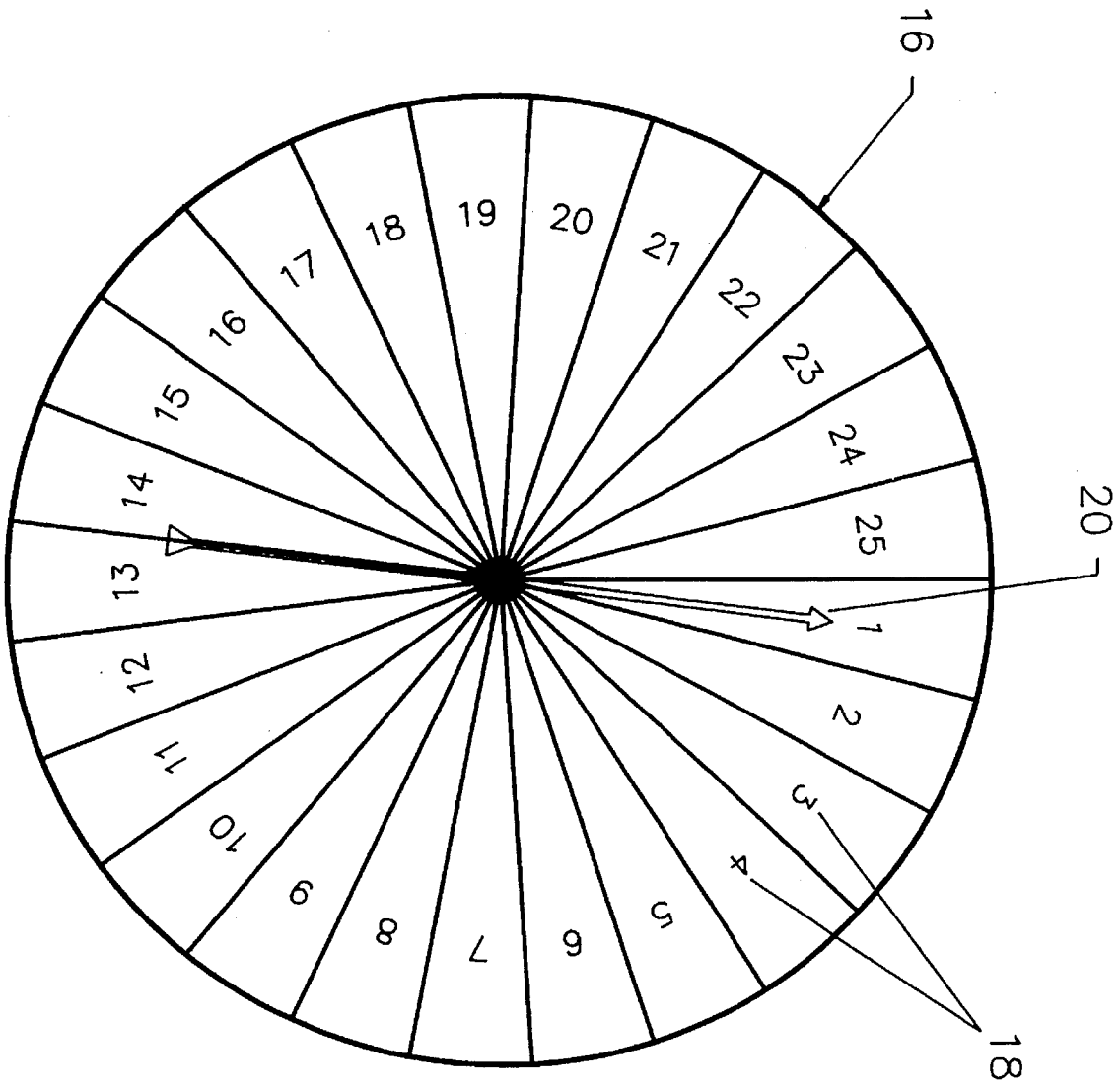
FIG. 2 is a plan view of a game wheel used by the host to determine the free spaces if one or more is desired.

I call my game SKILO to indicate that the game is one of skill and knowledge, as distinguished from one of chance. The name SKILO is displayed at 10 across the top of the board 12 in FIG. 1, the board therefore being rectangular. A square area beneath the name is divided into 25 areas 14 which are numbered from 1 to 25 in vertical columns and horizontal rows. Each of the 25 areas also has an answer, which may correspond to one or more questions, and which in the illustrative embodiment are the names of well known persons.

The SKILO Board 12 does not have a free space on it, but the host can have one or more to be determined at the beginning of each game. The location and number of free spaces, If any, is determined by the game host using a spinner board 16 or by his designation.

The spinner board 16 has 25 equal segments 18 of a circle and is circular in nature. A spinner or pointer 20 is rotatably positioned on the board at the center thereof and is spun by the host, or, by prearrangements, by players in rotational order. If the spinner 20 should stop on number 1, for example, this would indicate that number as a free space for that game.

Questions presented are drawn by the game host at random and presented one by one. Using the example SKILO board 12, the correct answer to the question might be George Washington, and the question could be "Who was the first president", or "Who was the father of his country?". While it is general knowledge a game contestant should know that the answer is George Washington, and the person holding the illustrated board would know that it is in position six and should promptly mark such position. This could be by way of a marker, or it could be simply a movable item placed on position six of the board.

Figure 3:
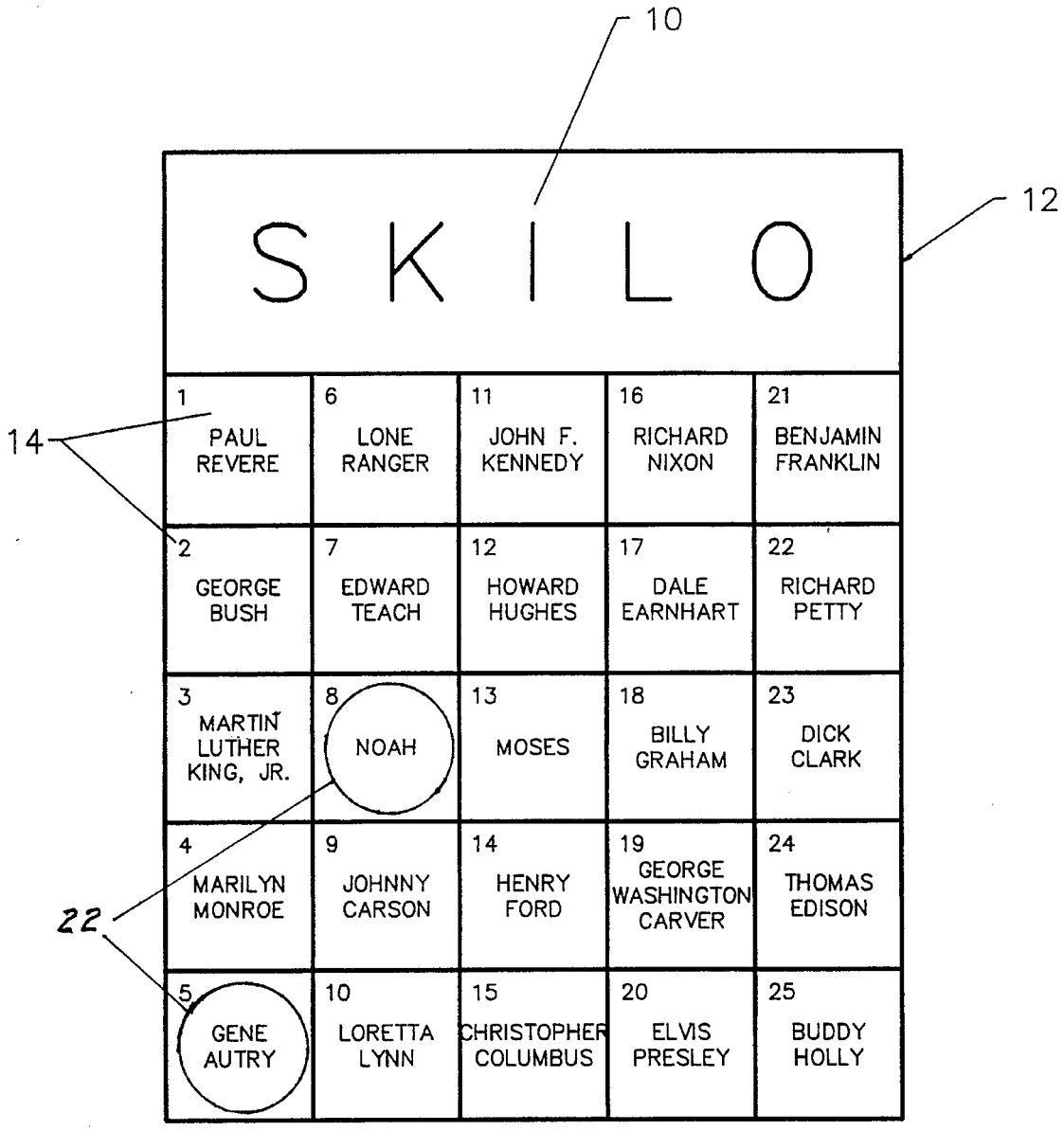
FIG. 3 is a view similar to FIG. 1, and showing a different game board.

Attention now should be directed to FIG. 3. It will be seen that this is identical with FIG. 1, except that answers 1 and 2 are different. Other answer boards (or sheets) will also have different answers in one or more positions. There will be a very large number of such answer sheets for each category of questions, but no answer sheets will be identical.

The lists of question may vary in character. 75 questions are on each category. For example, there are 75 questions on the question seets labeled "HEROS ARE THERE FOR NOLAN RYAN FACTS". There can be as many lists of questions as a reasonable person might know the answers to. With almost limitless lists of questions and 75 answers to each list, a very large group of answers can be compiled, and there is no correlation between the numbers on the lists of questions and on the answer sheets.

Markers, such as those indicated be numberal 22 in FIG. 3, are provided, and when a question is called for which a person knowing the answer has it one his answer board (or sheet) recognizes it, he places the marker on that answer. Persons playing the game must have sufficient intelligence to associate the anser with the position on the board to place the marker on the correct number.

I do not wish to imply that all questions would be political in nature. For example, the game host might have a list of questions regarding citizenship, or it might be presidents, or it might be famous people, or a state or specific areas of knowledge such as Law or Medicine, etc. Obviously, names could appear on more than one game question sheet, as most presidents are famous for something besides their having been president. The first person to place markers on the game board then being used in a predetermined and announced configuration or pattern is considered to be the winner. The game host will stop the game when someone claims to be the winner, and will have an assistant check the prospective winning board to verify its correctness.

It will now be seen that SKILO is a game of skill and knowledge, and not one involving any chance or luck, to win the game the player must have knowledge of the subject matter, and demonstrate the ability to use that knowledge. A player must select, based on his knowledge of the subject matter, the correct answer to the questions read out or posted before the players. The winner is the player or players that recognize the answers to the questions and marks his board accordingly, forming the designated pattern on the board. The questions are called, pointed out or read at random by a game host. Upon the questions being presented in this manner, the player must select and locate the correct answer, if it appears on his board. If the player knows the answer to the question, he then marks the appropriate square containing the answer. When he has marked a sufficient number of answers to form the designated pattern for that game, he is the winner. The host designates the different patterns that must be formed on the board at the beginning of each game. The only way to win a game of SKILO is to know the answer to the question asked and recognize that answer on the answer squares that appear on the SKILO game board. If you are the first person or persons playing the game to form whatever designated pattern was announced for the game, then you are the winner or winners of that game. If you are the first player to form a designated pattern or patterns on your board, whether you be a single player or a multiple player, then you yell SKILO. It will be noted at this time that for multiple playing, a person may have more than one subject matter game board, and thus participate in several different games at the same time. When a person has yelled out SKILO, the host will stop the game and will have an assistant check the purported winning board to verify its correctness. to do this, the assistant will call back to the host the answers that have been marked on the board, and he will check the answers against the tally of questions that he has asked. If you have marked your board correctly with the answers that you have recognized forming the designated pattern, then you have won that game of SKILO.

In the event of multiple winners, which is possible due to different game boards, the prize can be split equally between the winners, or the host can establish a playoff to determine the winner, as has been determined before the game starts.

It is possible for a player to play more than one game of SKILO at the same time. Different SKILO games are determined by the different subject matters forming the questions and answers for the game. Such subject matters can be "World Geography" or "Presidents and Famous People", or "States and Capitals" or any other subject matter for which the SKILO game boards have been prepared. However, it will be noted that the questions and the correct answers are highly diverse, but should, or could, be within the scope of knowledge of a reasonable adult or other knowledgeable person. To play two or more SKILO games at the same time, the host will still ask or display questions the same as if only one game were being played. For example, if the host should ask or display question number 7, the player would determine what question number 7 was for each different SKILO game which he was then playing, and if he knows the answer to the question and recognizes it in one of the appropriate squares, he would mark the square the same as he would in a single SKILO game. Following this procedure, all boards of a number of different subject matters SKILO games can be played at the same time with the same or different players.

When a person is playing multiple SKILO games at the same time, the host will announce at the beginning of the game what the designated patterns are to be for each SKILO game. Unless he announces to the contrary, each player playing multiple SKILO games at the same time can win on each board upon forming the designated pattern on the board regardless of the number of different SKILO games that the player is then playing. He will respond to the formation of the designated pattern on each board as though it were a single board. If two different SKILO games are being played at the same time when a player has won on one of the SKILO game boards, the game will continue in the other SKILO game as if only one game was being played. The host can indicate at the beginning of the game that while each different SKILO game will have its own designated pattern, the first player to win on any of the different subject matter SKILO games will win the prize then being played for.

SKILO is a game of skill and knowledge. It is for persons who can read and who are able to understand the questions asked, or displayed, and not only know the answer to the question, but be able to locate it if it is present on the SKILO game board. The player must be able to locate the answers on the SKILO game board, and to mark them to count. Players must be able to recognize the different designated patterns that are announced by the host.

The host will have 75 different questions for each different subject matters SKILO game. Every question that is asked or displayed to the player may or may not appear as an answer on the SKILO board possessed by the player. If it does appear and is recognized, then the player may mark it. The player may play as many different SKILO boards on each different subject matter SKILO board as he feels he can play and not hold up the game.

If 74 questions are asked, or displayed, and no player has the designated pattern or patterns on his SKILO board, the SKILO game is over without a winner. The 75th question is never asked, as at that time, whether they know it or not, every player in every game would have every answer square in his SKILO game board covered. Each SKILO game may have different designated patterns, and a different prize awarded to the winner of each game. Upon the announcement at the beginning of the game by the host, only one prize can be involved with players increasing their opportunity to win by broadening out the area or fields from which they will be asked questions.

Any SKILO player caught cheating will have his SKILO game voided for that game, but will be allowed to play subsequent games scheduled for that time upon a promise and commitment not to cheat henceforth at the game. Cheating will comprise any act which will allow the player to mark an answer on his SKILO board without the required knowledge and skill to play the game.

SKILO is a unique game for all age groups that have the required knowledge and skill to play the specific subject matter SKILO game being offered. It not only has the excitement of winning things of value, but has the unique ability to stimulate the intellect, encourage study, reading, and a general development of one's overall knowledge and skill.

The SKILO game should now be clear, and it will be understood that the specific example is by way of illustration only. Various changes will be apparent to those skilled in the art, and will form a part of the present invention insofar as they fall within the spirit and scope of the appended claims.

The invention is claimed as follows:

1. A game of skill and knowledge for mature players, comprising:

a plurality of different game boards, each game board having a grid of spaces defined by different vertical columns and different horizontal rows, each space having an answer indicia, and each space being numbered with a number indicia, wherein each space on a game board having a different number indicia to form a numbering sequence on said game board, and the numbering sequence in each of said different game boards being identical;

a list of questions to be asked by a host, each question having a correct answer corresponding to answer indicia on at least one of said spaces on at least one of said different game boards, the questions being numbered, the question numbers and said number indicia having no relation to one another, the questions being arranged in different categories in each list and;

a spinner having different segments thereon marked with numbers corresponding to said number indicia, said spinner being manually operable to determine which space or spaces will be free.

2. A game board as set forth in claim 1 wherein said numbering sequence comprises consecutive numbers from one adjacent space to another on said game boards.

3. A game as set forth in claim 1 and further including a plurality of markers to be placed on correct answers on game boards.

4. A game board as set forth in claim 3 wherein said numbering sequence comprises consecutive numbers from one adjacent space to another on said game boards.

5. A game of skill and knowledge for mature players comprising:

a plurality of different game boards, each game board having a grid of spaces defined by different vertical columns and different horizontal rows, each space having an answer indicia and each space being numbered with a number indicia, wherein each space on a game board having a different number indicia to form a numbering sequence on said game board, and the numbering sequence in each of said different game boards being identical;

a list of questions to be asked by a host, each question having a correct answer corresponding to answer indicia on at least one of said spaces on at least one of said different game boards, the questions being numbered, the question numbers and said number indicia having no relation to one another, the questions being arranged in different categories in each list and; means having different segments thereon marked with numbers corresponding to said number indicia, said means manually operable to determine which space or spaces will be free.

* * * * *